US007491015B2

(12) United States Patent
Coppes et al.

(10) Patent No.: US 7,491,015 B2
(45) Date of Patent: Feb. 17, 2009

(54) OUTWARDLY DISHED END PLATE FOR STORMWATER CHAMBER

(76) Inventors: Bryan A Coppes, 900 Mix Ave., No. 42, Hamden, CT (US) 06514; Jonathan F Smith, P.O. Box 262, Quaker Hill, CT (US) 06357

( * ) Notice: Subject to any disclaimer, the term of this patent is extended or adjusted under 35 U.S.C. 154(b) by 0 days.

(21) Appl. No.: 11/158,562

(22) Filed: Jun. 22, 2005

(65) Prior Publication Data

US 2005/0238434 A1 Oct. 27, 2005

Related U.S. Application Data

(60) Division of application No. 10/402,414, filed on Mar. 28, 2003, now Pat. No. 7,052,209, which is a continuation-in-part of application No. 09/849,768, filed on May 4, 2001, now Pat. No. 7,118,306.

(60) Provisional application No. 60/202,255, filed on May 5, 2000, provisional application No. 60/368,764, filed on Mar. 29, 2002.

(51) Int. Cl.
*E02B 11/00* (2006.01)

(52) U.S. Cl. ..... 405/42; 405/46; 210/170.01

(58) Field of Classification Search ..... 405/43–49, 405/124–127, 42; 210/170.01, 170.03, 170.08
See application file for complete search history.

(56) References Cited

U.S. PATENT DOCUMENTS

| | | | | |
|---|---|---|---|---|
| 4,445,542 | A * | 5/1984 | Fouss et al. | 138/94 |
| 5,087,151 | A | 2/1992 | Dituillo | 405/43 |
| 5,556,231 | A | 9/1996 | Sidaway et al. | 405/48 |
| 5,773,756 | A * | 6/1998 | DiTullio | 174/37 |
| 5,839,844 | A | 11/1998 | Nichols et al. | 405/43 |
| 6,076,993 | A * | 6/2000 | Gray | 405/43 |
| 6,602,023 | B2 | 8/2003 | Crescenzi et al. | 405/42 |

* cited by examiner

*Primary Examiner*—Tara L. Mayo
(74) *Attorney, Agent, or Firm*—Charles Nessler; Steven McHugh

(57) ABSTRACT

An end plate for closing off the end of an arch shape cross section corrugated storm water chamber, which receives water for dispersal beneath the surface of the earth, has a dished portion which projects outwardly from the end of a chamber to which it is attached, preferably by means of a flange which engages the corrugations of the chamber. Ribs inside the end plate add strength.

12 Claims, 5 Drawing Sheets

OUTWARDLY DISHED END PLATE FOR STORMWATER CHAMBER

This application is a divisional-continuation of patent application Ser. No. 10/402,414 of Kruger et al., filed Mar. 28, 2003, now U.S. Pat. No. 7,052,209 which was a continuation in part of application Ser. No. 09/849,768, filed May 4, 2001now U.S. Pat. No. 7,118,306. This application claims benefit of provisional applications Ser. No. 60/202,255, filed May 5, 2000 and No. 60/368,764 filed Mar. 29, 2002.

TECHNICAL FIELD

The present invention relates to molded non-metal chambers for subsurface receipt and dispersal of waters, in particular to molded plastic chambers for receiving stormwater.

BACKGROUND

In use, a storm water chamber is buried beneath the surface of the earth, to collect storm water, such as runoff from parking lots and the like. In a typical stormwater chamber installation, a multiplicity of chambers is laid into cavities in the earth as large array, and then covered over with gravel, stone or soil. See U.S. Pat. Nos. 5,156,488, 5,511,903 and 5,890,838 for examples of chambers. Often the chambers are placed on and buried in gravel; and overlaid with more gravel or soil or a paved surface for motor vehicle traffic or parking. Thus, it is important that they be structurally sound.

SUMMARY

An object of the invention is to provide stormwater chambers and related components, including end plates, which are strong, economic to produce, which nest well for shipping, which connect together well, and which are adapted for receiving internal flow control baffles.

In accord with the invention, an arch shape cross section chamber for receiving and dispersing stormwater when buried beneath the surface of the earth is corrugated and has a cross section geometry which preferably is a continuous curve.

In further accord with the invention, the chamber is used in combination with a domed end plate, or end cap, which fits onto the end of the chamber to prevent gravel and soil from entering, preferably by engaging a corrugation at the chamber end. The preferred end plate has a dished portion which projects outwardly (i.e., convexly) from the end of the chamber, and it has cross hatch ribbing on the interior side. A hole may be cut in the end plate, so an input pipe can deliver water to the chamber.

In further accord with the invention, the end plate and chamber are shaped so the flange outer edge of the end plate fits within the corrugations in the central part of the chamber, which corrugations are larger than those at one end. When so positioned, and when the dome has a cut out at an elevation substantially above the elevation of the base, water flow from one part of the chamber, or from one part of a series of interconnected chambers to another part, is inhibited.

Preferably, the curve of the chamber is a truncated semi-ellipse, that is, less than half an ellipse, wherein the major axis of the ellipse lies along the vertical axis of the chamber. Thus, the vertical height of the chamber interior is less than half of the length of the major axis of the semi-ellipse of which the chamber geometry is a portion.

In further accord with the invention, a storm water chamber comprises a combination of standard corrugations along most of the length, in combination with smaller one-end corrugations, to enable joining of chambers in overlap fashion, as a string; corrugations which have elliptically curved corrugation widths when viewed from the side of the chamber; and, sidewall base flanges which have turned up outer edges in combination with fins which connect said edges with the curved chamber sidewall.

The foregoing and other objects, features and advantages of the invention will become more apparent from the following description of preferred embodiments and accompanying drawings.

DESCRIPTION

The present invention is described in pending U.S. patent Ser. No. 09/849,768 and Ser. No. 10/402,414, both of Kruger et al.,. The disclosure and drawings thereof are hereby incorporated by reference. The present invention is also described in two provisional patent applications, namely Ser. No. 60/202,255, filed May 5, 2000, and Ser. No. 60/368,764 filed Mar. 29, 2003, the disclosures of which are also hereby incorporated by reference.

In the incorporated references, the invention is variously referred to as a storm management system and, in part, as a corrugated stormwater chamber. A typical chamber may be 45-50 inch wide at the base by 30 inch high at the peak interior and 91 inch long. It is preferably made of injection molded high density polypropylene, polyethylene or comparable material. Preferably it is made by injection molding, for precision, although other known methods of fabrication may alternatively be used.

Figure 1:
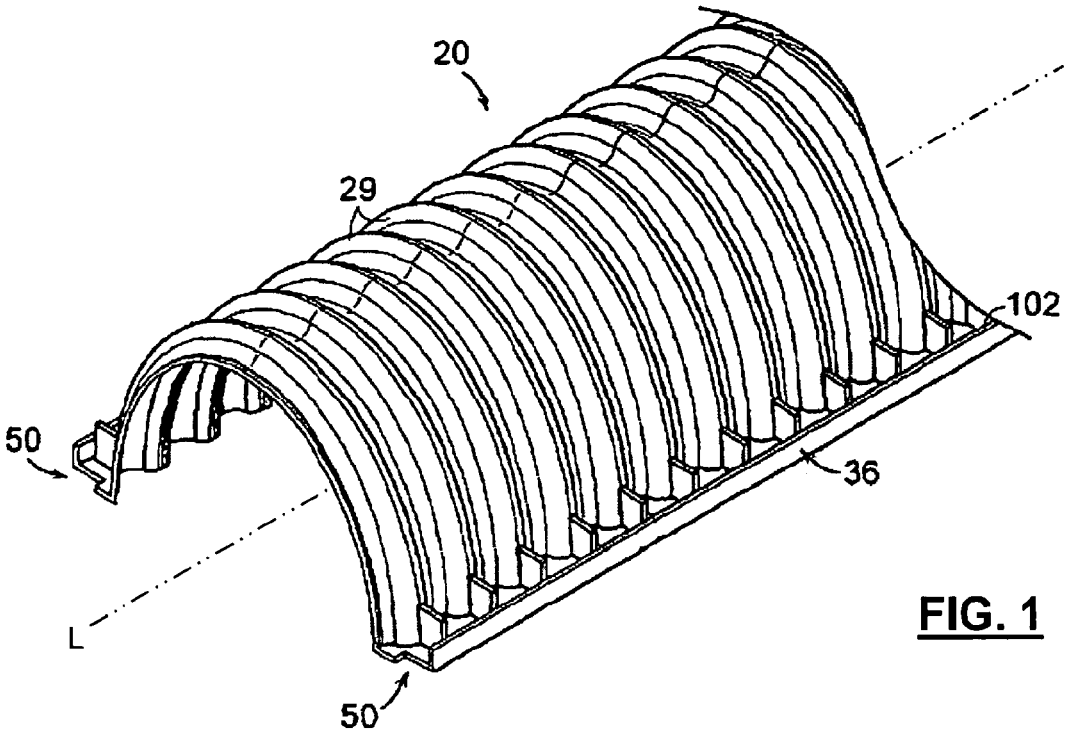
FIG. 1 is a partial isometric view of a molded plastic chamber.
Figure 2:
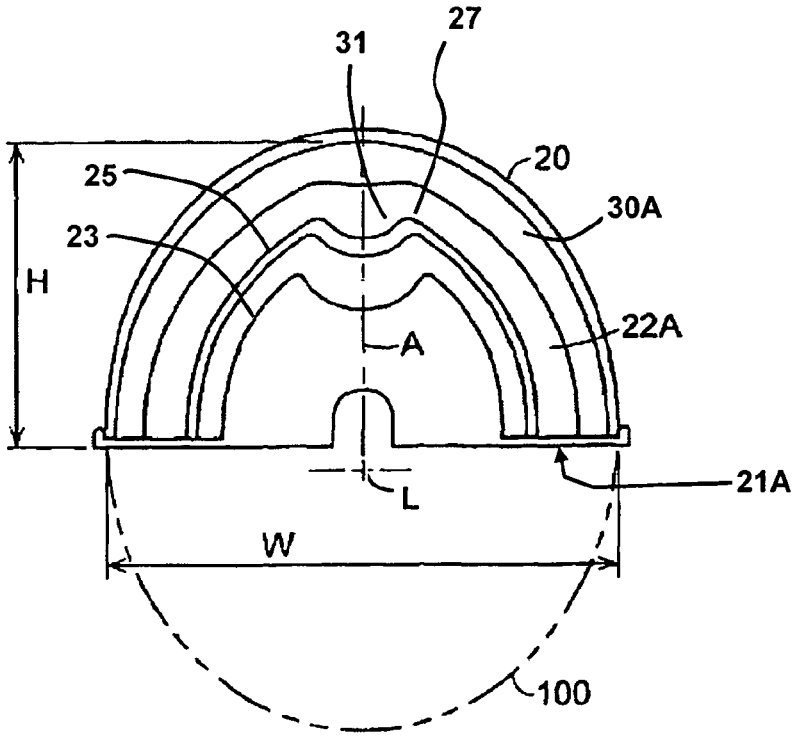
FIG. 2 is an end view of a chamber like that in FIG. 1, with a stepped end plate attached at the end.

FIG. 1 shows a molded plastic chamber 20 having a continuous an arch shape cross section and corrugations 24 running along the arch shape from opposing side base flanges 36. The chamber has a longitudinal axis L and a vertical axis A. See also FIG. 2. Preferably, the chamber has a continuous curve cross section geometry, for strength. More particularly, the chamber has a cross section geometry which is a truncated semi-ellipse, as illustrated by FIG. 2 (which shows an end plate 21A in place, which is discussed below). The geometry is less than half an ellipse 100, the major axis A of which lies along the vertical axis of the chamber. Thus, the vertical height is less than half of the length of the major axis of the semi-ellipse. As shown in FIG. 2, the chamber has an inner height H and an inner width W. Preferably, the chamber has a width to height ratio (W/H) between about 0.5 to 1 and 2 to 1, more preferably between 1 to 1 and 2 to 1. Preferably, the height H is between about 44 and 48 percent of the length of the major axis of the ellipse of which the truncated semi-ellipse is a portion.

The bulk of the body of the chamber has corrugations 29 of a standard dimension, including first end corrugation 28, except for at least a smaller second end corrugation 26. See FIG. 4. The difference in dimension between corrugation 26 and the "standard" corrugation is roughly equal to or greater than the wall thickness of the chamber at the corrugations, which thickness will be typically in the range 0.150-0.188 inch for an injection molded chamber.

Figure 5:
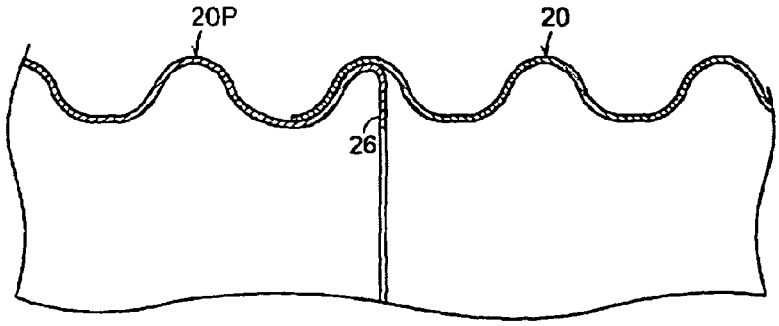
FIG. 5 is a fragmentary lengthwise cross section of the joint formed between two mated chambers.

Thus, as shown in the partial vertical center-plane cross section of FIG. 5, the first end of a first chamber 20 can be laid on top of the second end of a second chamber 20P, so the chambers may thereby be joined together in the form a string of chambers. If a shorter chamber length is desired, as when a factory-made chamber is too long for the application, the chamber may be cut, for instance, at the chamber midpoint in a valley. Thus the corrugation which is at the newly cut end of the chamber can be engaged with the smaller corrugation 26 at the second end of another chamber, overlapping it, to form a joint.

Figure 6:
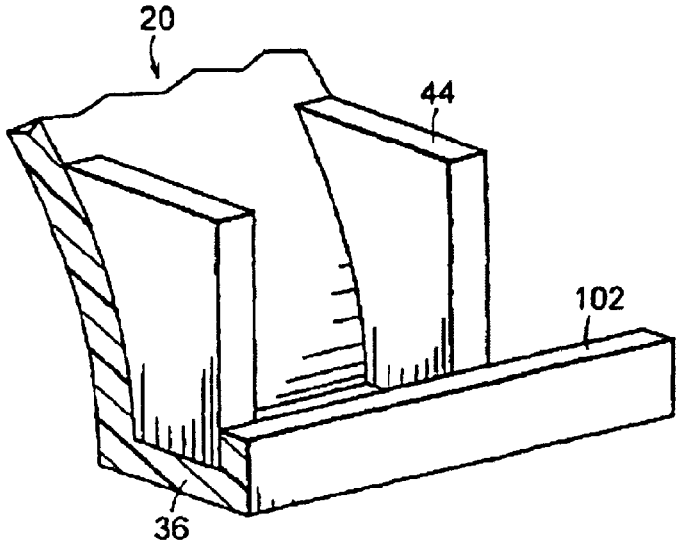
FIG. 6 is a fragmentary isometric view of the end of a chamber like that in FIG. 1, to illustrate details at the base of the chamber sidewall.

The opposing side base flanges 36 have turned up outer edges 102, called support members, for providing strength in the longitudinal direction. See FIG. 6. The base flanges 36 have cutout portions 50 at one end, where the large corrugation 28 is. See FIG. 1. Thus, when chambers are overlapped to form a string, the flanges 36 of the small end fit within the cutouts, and the chambers better fit together, than would be the case without the cutouts.

Figure 3:
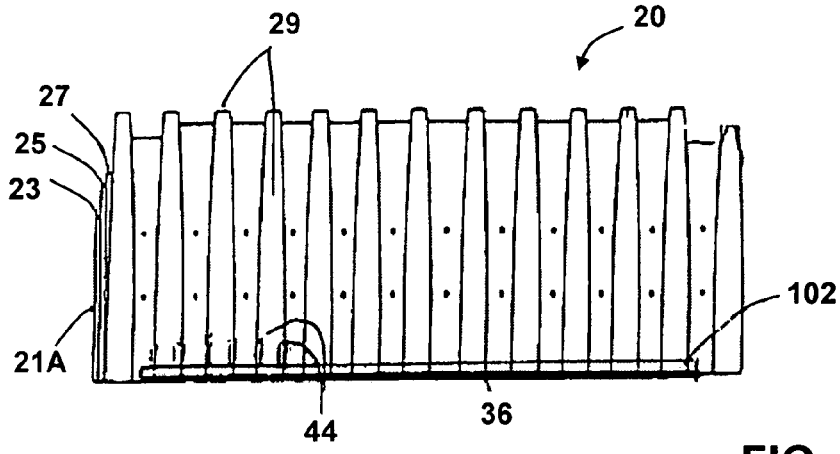
FIG. 3 is a side elevation view of a chamber with a stepped end plate attached to one end.
Figure 4:
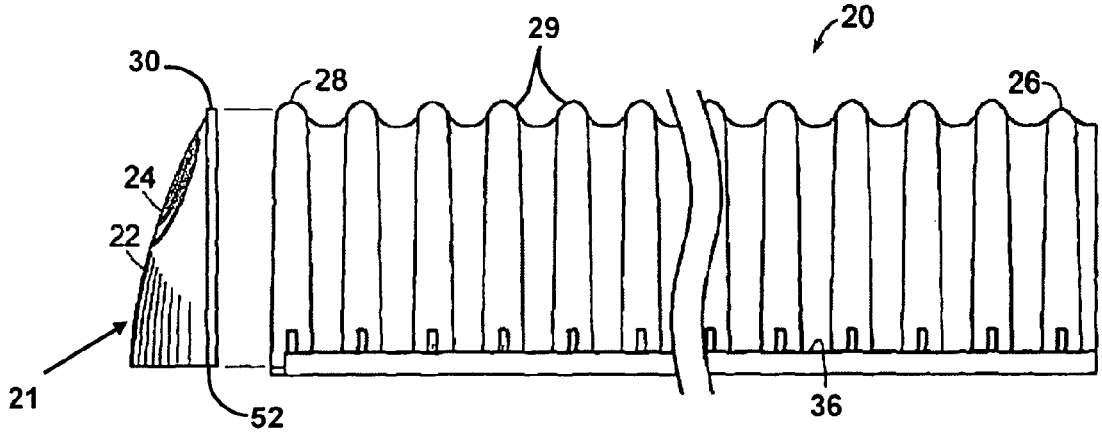
FIG. 4 is a side elevation view of a chamber having a dome end plate at one end, where the convex surface dished out portion thereof faces outwardly.

An end plate 21, 21A, preferably the kind of end plate which is also called an end dome here, is used to close off the open end of a chamber, as shown in the side elevation views of FIG. 3 and FIG. 4. The two embodiments of end domes 21, 21A have corresponding parts denoted by numerals with suffixes. The end dome 21 has a dished or convex shape portion 22 (as viewed from the exterior of the chamber, when installed) and an arch shape flange 30 running around the dished portion. Compared to the essentially flat end plates of the prior art, the end dome has improved resistance to the load of encompassing compactable media such as crushed stone or soil which impinges on the dome when the chamber is buried and in use. The dished shape also provides more volume to the interior of a closed-off chamber than does a flat end.

Figure 7:
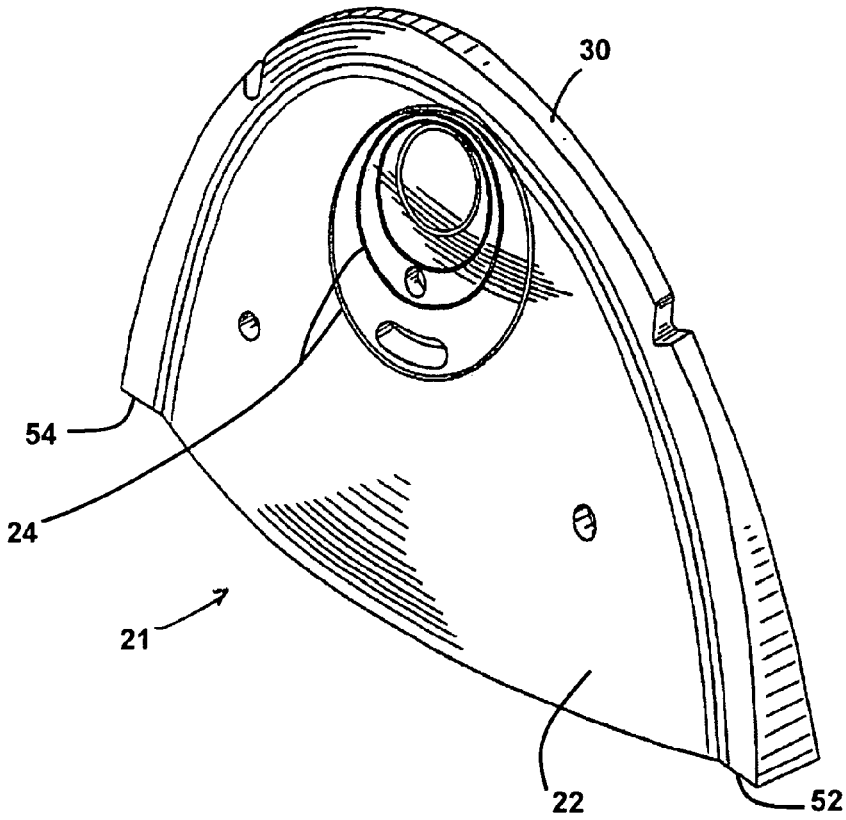
FIG. 7 is an isometric view of an end plate having a dished portion.
Figure 8:
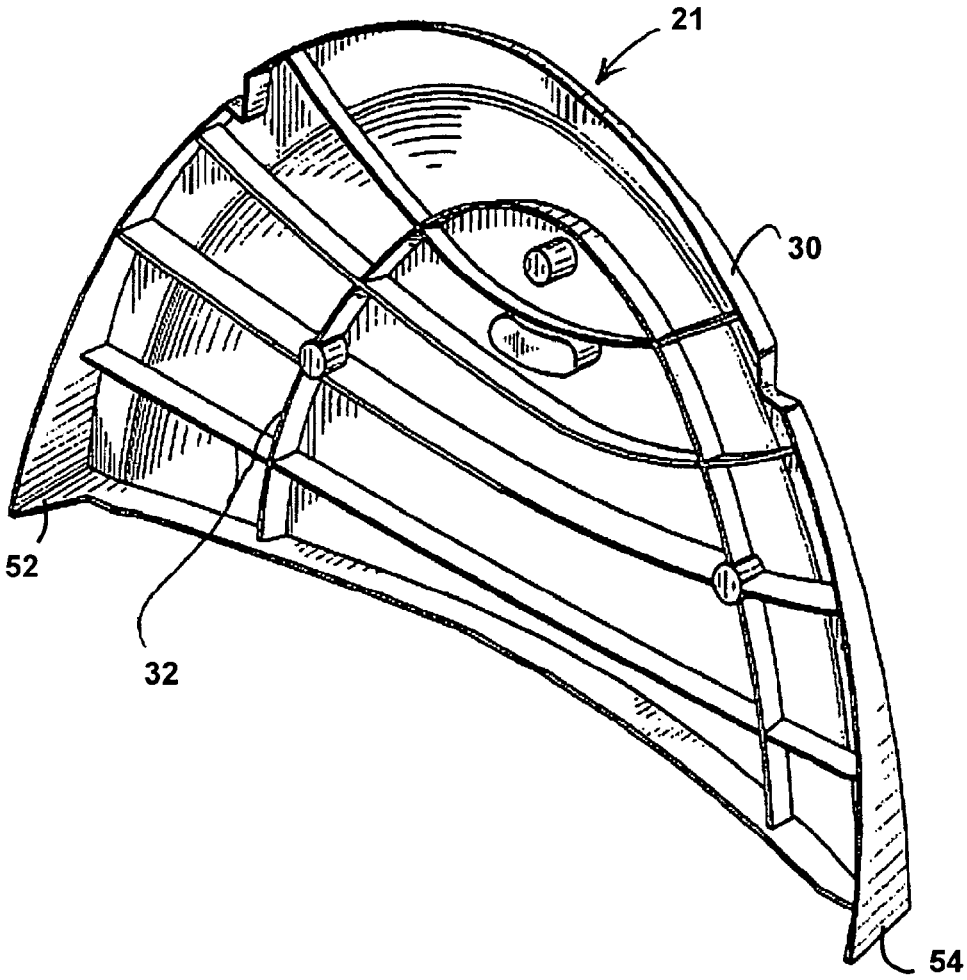
FIG. 8 is an isometric view of the interior of the end plate of FIG. 7.

FIGS. 7 and 8 show end dome 21. The interior of the dome has cross hatch ribbing 32, to provide further strength to the dished portion. The arch shape flange 30 of the end dome has an outer shape which is less than or equal to the outside dimension of a smaller corrugation 26 of the chamber. Thus, the flange 30 slips within corrugation 28 at the first end of the chamber 24, just as does the smaller corrugation 26 of another chamber. Preferably, the fit of flange 30 at end corrugation 28 is intentionally looser than the fit of the smaller corrugation 26, to the extent that the flange will also fit within the smaller opposing end corrugation 26 of a chamber. Thus only one-design end dome is needed for closing both ends of chamber 20, with its differing dimension end corrugations. In the generality of the invention, the end dome described here can be used on other kinds of chambers, including leaching chambers. The flange 30 of a preferred end dome 21 can also fit within any of the other corrugations 29 of the chamber 20, along the chamber length. Thus, if the chamber 20 is cut at any point along its length, to form a shortened length chamber, the end dome can be used as a closure at the cut end.

When soil pushes on the dome end plate, there is a lateral outward force, as the dished portion tries to flatten. So, the loose fit referred to above is not so loose as to prevent the dome flange or periphery from engaging the inside of a chamber corrugation and pushing outwardly on it. Since the chamber is backed by soil or stone lying along the length of the chamber, the chamber in vicinity of said corrugation resists the outward force. Thus, the dome endplate in the invention provides substantially greater strength and stiffness than does a flat end plate.

The shape of the dished portion 22 of an end dome may vary. Dished portion 22 may have different contours which include those which may be characterized as semi-rounded, bowed, semi-spherical (and, when considering both the exterior and interior of the end dome) plano-convex, convexo-concave and convexo-convexo. FIGS. 3, 4, 7 and 8 show that a preferred dished portion 22 of end plate 21 is a truncated, preferably curved, structure; and, the bottom of the dished portion is free of any flange and bulges outwardly from vertical plane of the flange and the associated chamber end. The base ends of the arch shape flange 52, 54 of the end plate 21 are at the same horizontal elevation of the base flanges 36 of a chamber when the dome closes off the end of a chamber. See FIG. 7 and FIG. 3-4.

FIGS. 2 and 3 show another end plate embodiment, namely end dome 21A. The dished portion 22A of the end dome comprises a series of generally arch shape steps 23, 25, 27, which will support a pipe passing through the end dome. Preferably, the steps have a substantially concave or scalloped upper portion. See portion 31 of step 27 in FIG. 2.

An end dome preferably has scoring which define places for circular cutouts or holes for a pipe which can carry water to or from the interior of chamber Cutout scoring 24 is shown for end dome 22 in FIG. 7.

The end dome may engage the end of a chamber in alternative ways, compared to the flange being captured within a corrugation as described above. For example, the end plate may engage a chamber end by means of protrusions which engage divots or openings in the chamber, or by one or more snap connectors that engage a lip at the open end of the chamber. A dome endplate 21 which has a flange which fits into the corrugations of the chamber 20, as described above, can be positioned within a corrugation at any point along the length of the chamber, to provide a baffle or act as a weir. In one such use, the dome may have a cutout or through-hole at an elevation. Alternatively, with the kind of loose fit mentioned above, there can be flow through the gap between the end dome and the chamber corrugation, so the end dome functions like a weir. If it is desired to prevent such flow, appropriate sealant or gasketing can be employed. Using a dome-as-weir creates subchambers within the length of a chamber. More than one dome may be positioned along the length of a chamber to create a multiplicity of subchambers. The dome-as-weir is used to make the subchamber function as a reservoir and settlement basin. Thus, water flowing along the length of the chamber will stagnate in velocity and desirable settling of entrained debris will be realized. Thus, by strategic placement of dome-weirs along the length of the chamber near the inlet end of a string of chambers, a preferential region for settlement of heavier than water debris is created. Cleaning is made easier. While the dome shaped end plate is preferred when a weir is desired, in the generality of this aspect of the invention, flat end plates may be used as weirs.

Figure 9:
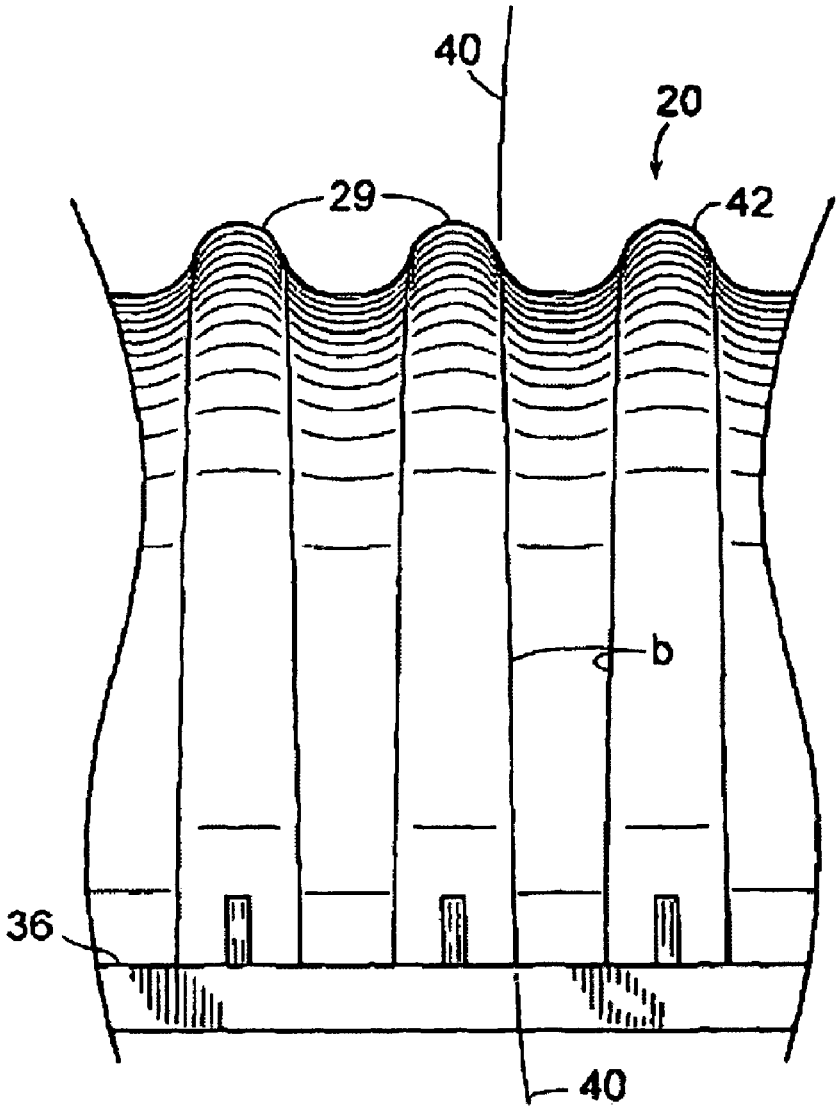
FIG. 9 is a side elevation view of a portion of a chamber, to illustrate corrugation contour in the vertical plane.

The chamber has another feature which is characterized by an approximate or exact elliptical curve. This is appreciated when the chamber length is viewed from the side in elevation, as in FIG. 9. The edge b of each peak corrugation 29, shown in somewhat exaggerated fashion in FIG. 9, is contoured as a segment of an imaginary second ellipse 40. The shape, and location in space relative to the chamber, of the second ellipse is selected so the corrugation tapers inwardly in side view, running toward the top 42 of the peak corrugation, as shown in the Figure. When chambers are stacked, the elliptical curve shape enables better nesting of the chambers than does a corrugation which has either no taper, or which has straight-line or planar taper, both referenced to the vertical cross sectional plane. The straightline taper, used in some prior art devices, either will not provide sufficient nestability, or will result in a corrugation width at the top becoming near zero, which is not good for strength.

In another aspect of the invention, the chamber has vertical standoffs in the form of fins 44, also called connecting elements, which are spaced apart along the opposing side base flanges 36. Fins 44 connect outer edges 102 with the sides of the peak corrugations of the nearby chamber sidewall, to provide support to the flanges in the direction normal to the length of the chamber. See FIGS. 1, 3, 4 and 6. The height of the fins is chosen to prevent the chambers from jamming one onto the other.

The inventions may be applied to chambers that have configurations other than the exemplary chambers; and, they may be applied to chambers used for other purposes than receiving and dispersing stormwater. For instance, the inventions may be applied to wastewater leaching chambers and to other arch like devices adapted for dispersing or gathering waters into or from soil and granular media.

Although this invention has been shown and described with respect to a preferred embodiment, it will be understood by those skilled in this art that various changes in form and detail thereof may be made without departing from the spirit and scope of the claimed invention.

We claim:

1. A combination of an arch shape cross section chamber having opposing side base flanges, for receiving and dispersing water when buried in water permeable medium, and an end plate, for closing off the end of the chamber and preventing the entry of said medium; wherein the endplate comprises:

a dished portion;

a flange running around the periphery of the dished portion, wherein said flange is configured to associate with the end of the chamber and the opposing side base flanges, to close off the end of the chamber; and a plurality of strengthening ribs running between the arch shaped flange of the endplate on the concave side of the dished portion; and an arch shaped rib running between a first base portion of the endplate and a second base portion of the endplate on the concave side of the dished portion, the arch shaped rib having a smaller radius than the arch shaped flange and having substantially the same shape as the arch shaped flange.

2. The combination of claim 1, wherein said dished portion projects outwardly from the end of the chamber.

3. The combination of claim 2, wherein said chamber has one or more corrugations running along the arch shape cross section at the end which is closed off; wherein the outer edge of said flange has a shape which corresponds with the shape of at least one of said corrugations; wherein the flange is engaged with the end of the chamber by fitting within said at least one corrugation; and, wherein force applied by the medium on the dished portion tends to make the flange press more tightly into the corrugation.

4. The combination of claim 3 wherein the chamber has additional corrugations along its length away from said closed off end; and, wherein the end plate flange is shaped so it may be engaged with the chamber by fitting within both said at least one corrugation and one of the additional corrugations.

5. The combination of claim 2 wherein the concave side of the dished portion faces toward the interior of the chamber.

6. The combination of claim 1, wherein the dished portion comprises arch shape steps which project outwardly from the end of the chamber.

7. The combination of claim 1, wherein the arch shape steps have concave upper portions for supporting a pipe extending from the end plate.

8. The combination of claim 1 wherein said end plate has scoring which defines locations for cutting one or more holes in the end plate, for passage of a pipe for carrying water to or from the chamber.

9. An endplate for closing off the end of an arch shape cross section corrugated chamber having opposing side base flanges used for receiving and dispersing water when buried in water permeable media, comprising:

a dished portion;

an arch shape flange running around the periphery of the dished portion, wherein said flange is configured to associate with the end of the chamber and the opposing side base flanges, to close off the end of the chamber;

a plurality of strengthening ribs running between the arch shaped flange of the endplate on the concave side of the dished portion; and an arch shaped rib running between a first base portion of the endplate and a second base portion of the endplate on the concave side of the dished portion, the arch shaped rib having a smaller radius than the arch shaped flange and having substantially the same shape as the arch shaped flange.

10. The endplate of claim 9 wherein the dished shape portion comprises arch shape steps.

11. The endplate of claim 10 wherein the arch shape steps have concave upper portions; wherein the steps are shaped to vertically support a pipe running through a hole made in the end cap.

12. An endplate for closing off the end of an arch shape cross section chamber used for receiving and dispersing water when buried in water permeable medium, comprising:

a flange, for engaging the endplate with the end of a chamber, wherein the flange runs upwardly in the vertical plane from opposing side flange base locations and along an arch shape path;

a dished portion, attached to the interior of said flange, wherein the base of said dished portion which runs in the horizontal plane between said flange base locations along a path which bulges outwardly from said vertical plane; and a plurality of strengthening ribs running between the arch shaped flange of the endplate on the concave side of the dished portion; and an arch shaped rib running between a first base portion of the endplate and a second base portion of the endplate on the concave side of the dished portion, the arch shaped rib having a smaller radius than the arch shaped flange and having substantially the same shape as the arch shaped flange.

* * * * *